US005588231A

United States Patent [19]

Mavrianos

[11] Patent Number: 5,588,231

[45] Date of Patent: Dec. 31, 1996

[54] SELF CONTAINED SNOW REMOVAL APPARATUS AND METHOD OF USE THEREFORE

[76] Inventor: Kostas Mavrianos, P.O. Box 954, Nome, Ak. 99762

[21] Appl. No.: 500,182

[22] Filed: Jul. 10, 1995

[51] Int. Cl.[6] ..... E01H 5/10

[52] U.S. Cl. ..... 37/227; 37/228; 126/343.5 R

[58] Field of Search ..... 37/226, 227, 228, 37/229; 126/343.5 A, 343.5 R

[56] References Cited

U.S. PATENT DOCUMENTS

| | | | |
|---|---|---|---|
| 2,576,829 | 11/1951 | Fiduccia | 37/227 X |
| 2,601,116 | 6/1952 | Gornick | 37/227 X |
| 2,681,828 | 6/1954 | Pollard | 37/227 X |
| 2,977,955 | 4/1961 | Altenburg | 37/227 X |
| 3,106,792 | 10/1963 | Park | 37/227 |
| 3,309,798 | 3/1967 | Devlin et al. | 126/343.5 R |
| 3,353,286 | 11/1967 | Marks | 126/343.5 R |
| 3,393,462 | 7/1968 | Picker | 37/228 |
| 3,484,961 | 12/1969 | Coslowsky | 126/343.5 R |
| 3,516,398 | 6/1970 | Hirahara | 126/343.5 R |
| 3,619,918 | 11/1971 | Morin | 126/343.5 R X |
| 4,785,561 | 11/1988 | Swanson | 37/228 X |

*Primary Examiner*—Randolph A. Reese
*Assistant Examiner*—Thomas A. Beach
*Attorney, Agent, or Firm*—Michael J. Tavella

[57] ABSTRACT

A snow removal device that uses a truck frame to hold a snow collecting, melting and storage system. A duct carries snow from a snow blower, mounted on the truck, into a large hopper. The hopper is covered to prevent the snow from leaving the hopper. A series of components is nested in the hopper as follows: A screen is at the top to catch debris. Below the screen are two separate heater pipe systems that circulate hot water. Below the pipe systems is a series of pyramid heaters. Below the heaters is a catch basin to hold the melted snow (as water) at the bottom of the hopper. This water is then pumped into a tank, mounted on the back of the truck trailer. Hot water is supplied by a pair of boilers also mounted on the trailer. Fuel for the boilers and the associated electrical equipment is also stored aboard the truck. Because the device is self contained fewer people are needed to operate it. Also, because there is no need to gather, lift and haul the snow, equipment such as dump trucks and loaders are no longer needed for snow removal, which saves a huge capital cost.

11 Claims, 10 Drawing Sheets

SELF CONTAINED SNOW REMOVAL APPARATUS AND METHOD OF USE THEREFORE

This invention relates to snow removal equipment and particularly to snow removal equipment that rides on a single chassis.

BACKGROUND OF THE INVENTION

In virtually all northern tier states and provinces, snow removal is a major winter problem. In many areas, snow does not melt until spring. Removing snow from streets and roads takes an enormous amount of tax dollars. Equipment is used to plow the snow into ditches or uniform rows. Snow blowers and loaders are then used to move snow from the roads into off road ditches, lawns, or into dump trucks, for hauling the snow to large open snow dumps. In some locations these dump sites store piles of snow forty feet high or more. At these dumps, more equipment is needed to push the snow into piles and to keep the piles managed. Such activities cost communities dearly.

Even in rural areas, where snow removal is not as problematic, finding places to store snow can be difficult. Moreover, the cost of the equipment for rural snow removal and storage is also expensive.

SUMMARY OF THE INVENTION

The instant invention is a self-contained snow removal device. It uses a truck chassis or large tractor-trailer frame to hold a heavy duty snow blower, which is mounted on the front of the tractor. A duct carries the snow from the blower into a large hopper. A series of components is nested in the hopper as follows: A screen is placed near the top of the hopper to catch debris. Below the screen are two separate heater pipe systems that circulate hot water. Below the pipe systems is a series of pyramid heaters. Below the pyramid heaters is a catch basin to hold the melted snow (as water) at the bottom of the hopper. This water is then pumped into a tank, mounted on the back of the truck trailer. Hot water is provided by a pair of boilers also mounted on the trailer. Fuel for the boilers and the associated electrical equipment are also stored aboard the truck. The hopper is covered to prevent the snow from being blown out of the hopper, as well as keeping the heat within the hopper. Moreover, the top keeps debris and other materials out of the hopper.

In this way, large quantities of snow can be collected, melted into water, and the water disposed of quickly and easily. Because the device is self contained fewer people are needed to operate it. Also, because there is no need to gather, lift and haul the snow, equipment such as dump trucks and loaders are no longer needed, saving a huge capital cost.

It is an object of this invention to produce a self contained snow removal system.

It is another object of this invention to produce a snow removal system that collects, melts and stores snow and the water produced therefrom on one tractor trailer chassis.

It is yet a further object of this invention to produce a snow removal system that is capable of operating on rural or urban streets and roads.

DETAILED DESCRIPTION OF THE INVENTION

Figure 1:
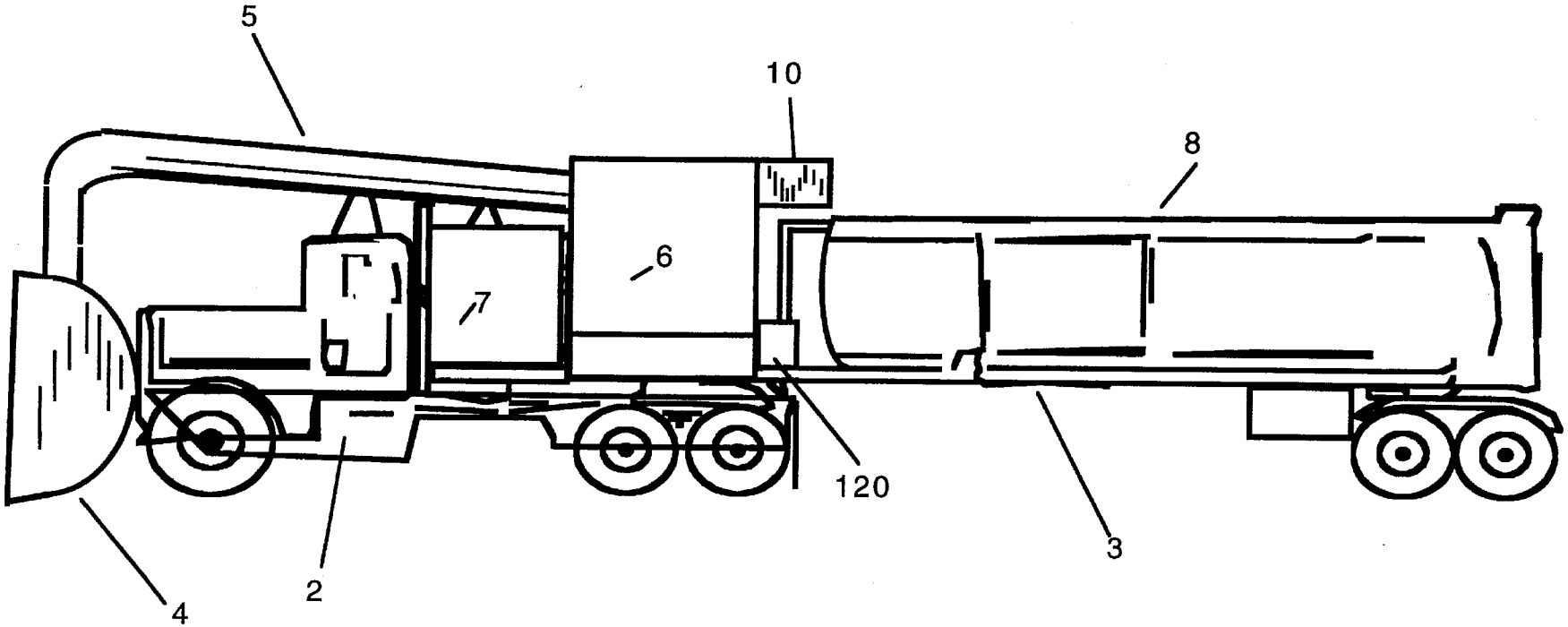
FIG. 1 is a left side view of the snow removal system mounted on a truck.
Figure 2:
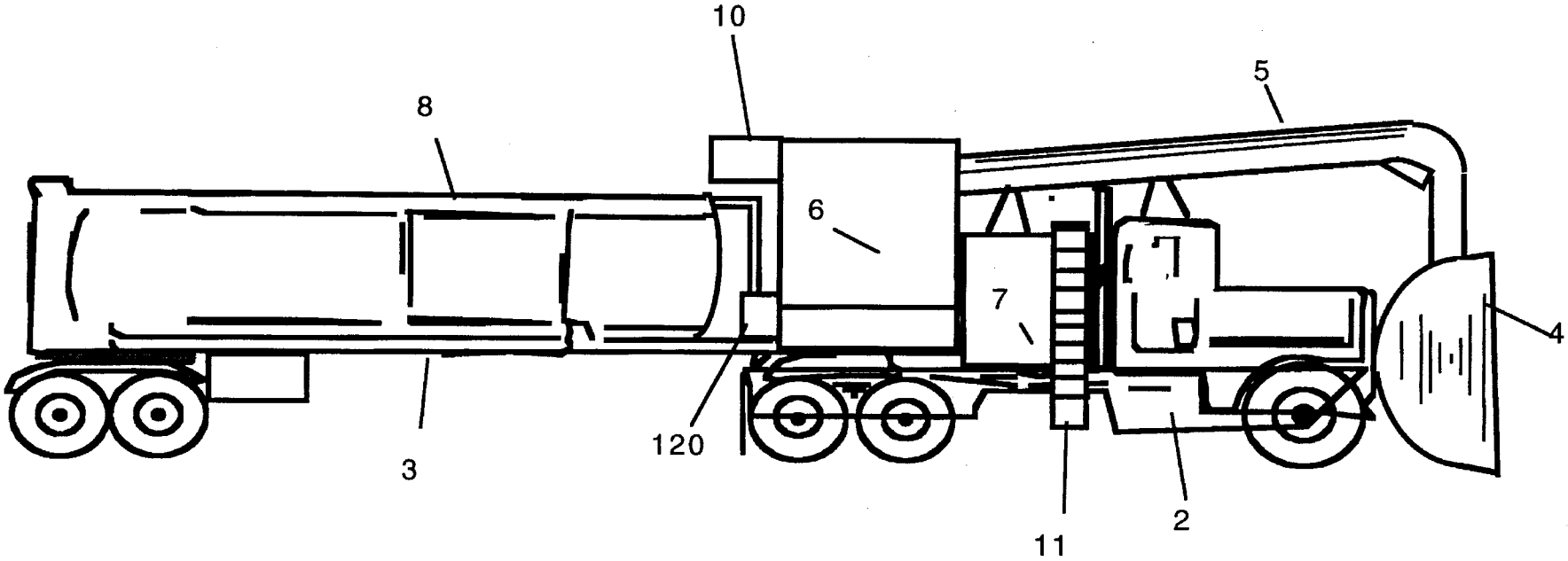
FIG. 2 is a right side view of the snow removal system mounted on a truck.

Referring now to FIG. 1, the snow removal system 1 is shown. The device as shown on the drawings is designed to be mounted on a standard tractor trailer that has a tractor unit 2 and a trailer unit 3. However, it is possible to build the unit on a smaller connected type vehicle having a cab and a rear platform. For the tractor trailer design, the main components of the system are: a standard road type snow blower 4, a feeder chute 5, a melting hopper 6, a boiler room 7, and a water storage tank 8. Other major components include a water pumping system 9 and a fuel storage tank 10. FIG. 2 shows the right side of the truck. Here, a ladder 11 is shown to allow access to the cover 80 of the melting hopper 6.

Figure 3:
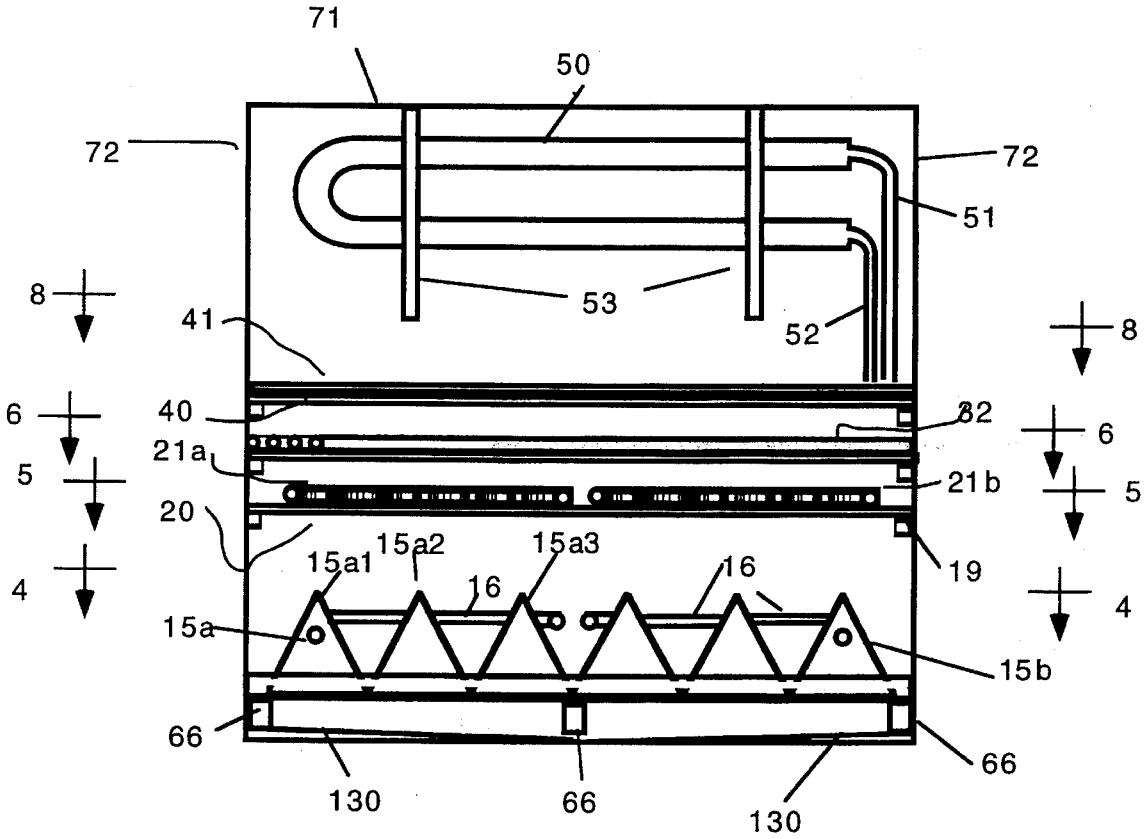
FIG. 3 is a side view of the melting hopper with a side wall removed.
Figure 4:
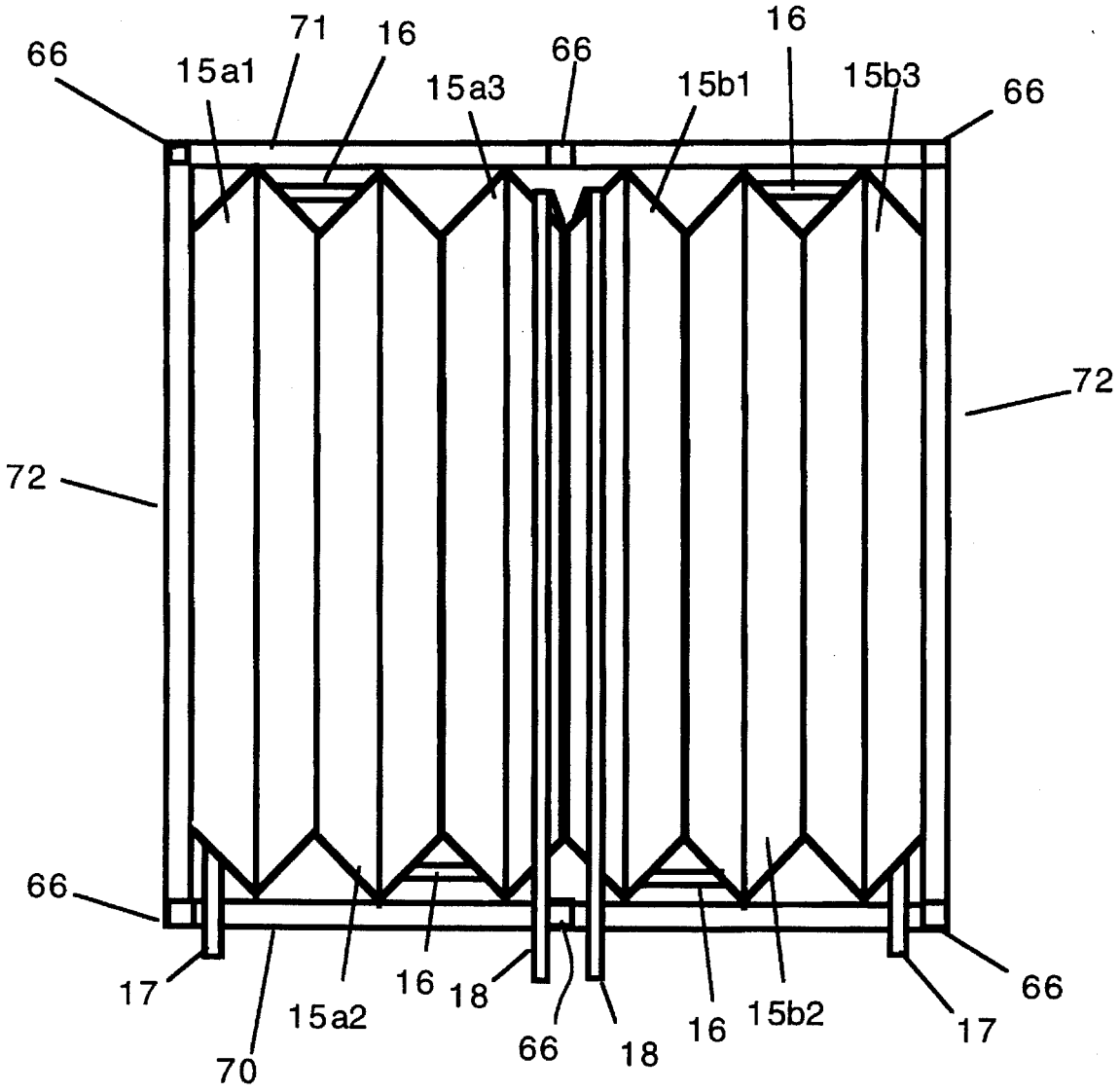
FIG. 4 is a top view of the pyramids in the melting hopper taken along the lines 4—4.

The key element of this system is the melting hopper 6. Details of the melting hopper 6 are shown in FIGS. 3–10. The hopper has a front wall 70, a rear wall 71, and two side walls 72. FIG. 3 is a side view of the melting hopper 6 with the front wall 70 removed. At the bottom of the melting hopper 6 are a number of pyramids. See also FIG. 4, which shows the top view of the pyramids. The pyramids are hydraulically connected with pipes 16 as shown. In the preferred embodiment, the pyramids are broken into two groups of three 15*a* and 15*b*. The pipes 16 circulate hot water through the pyramids. The pipes 16 are arranged so that water enters through the end pyramid 15*a*1 at inlet 17, passes through the length of the first pyramid 15*a*1, then passes through pipe 16 to the next pyramid 15*a*2, where the hot water passes through the second pyramid 15*a*2. Water thus circulates until it enters the third pyramid 15*a*3 in the group. Once it passes through the third pyramid 15*a*3, it exits through the outlet 18. Water follows the same type of circulation in the second set of pyramids 15*b*1, 2 and 3, as in the first set of pyramids 15*a*.

Figure 5:
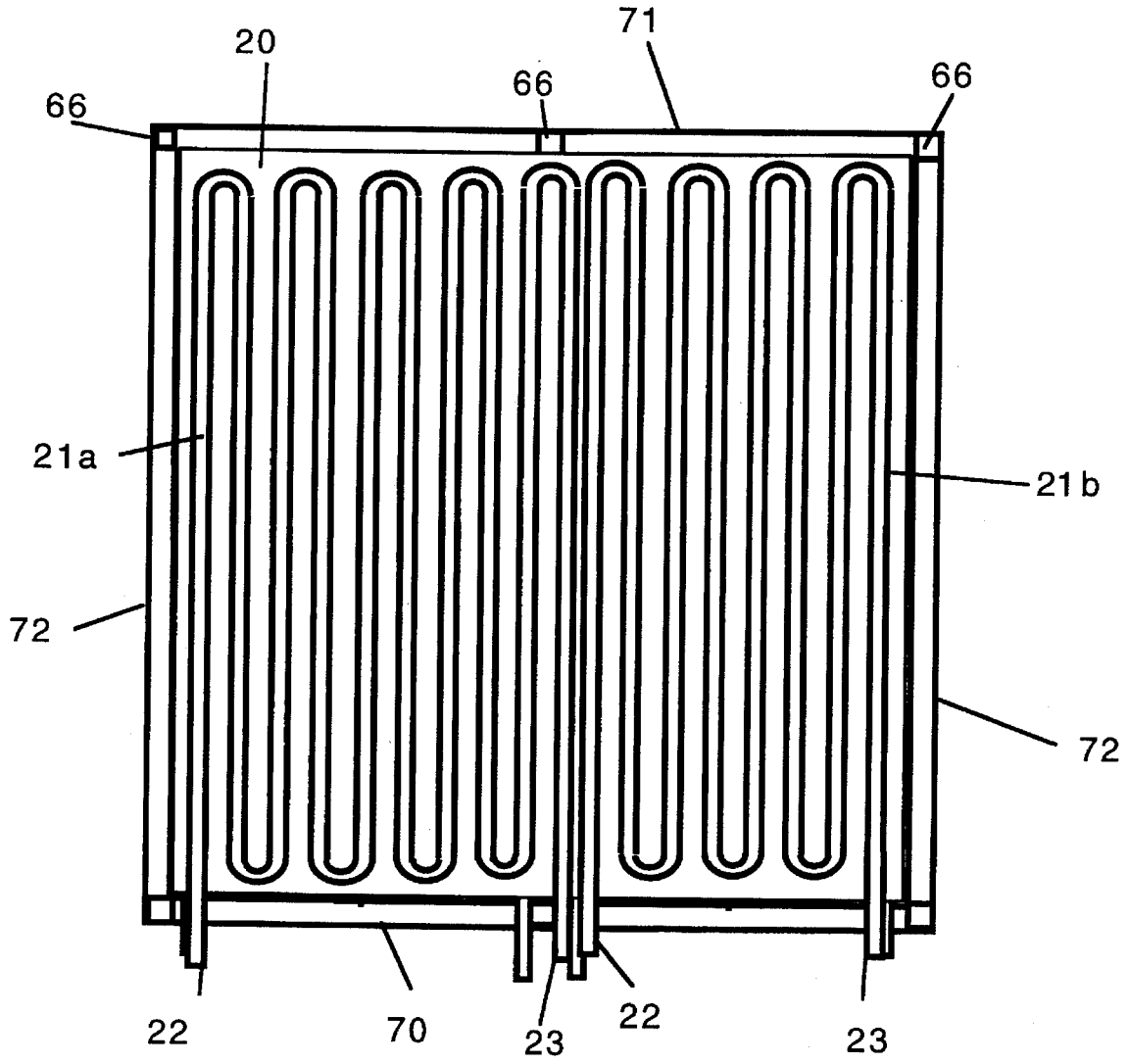
FIG. 5 is a top view of the lower set of melting pipes taken along the lines 5—5.
Figure 6:
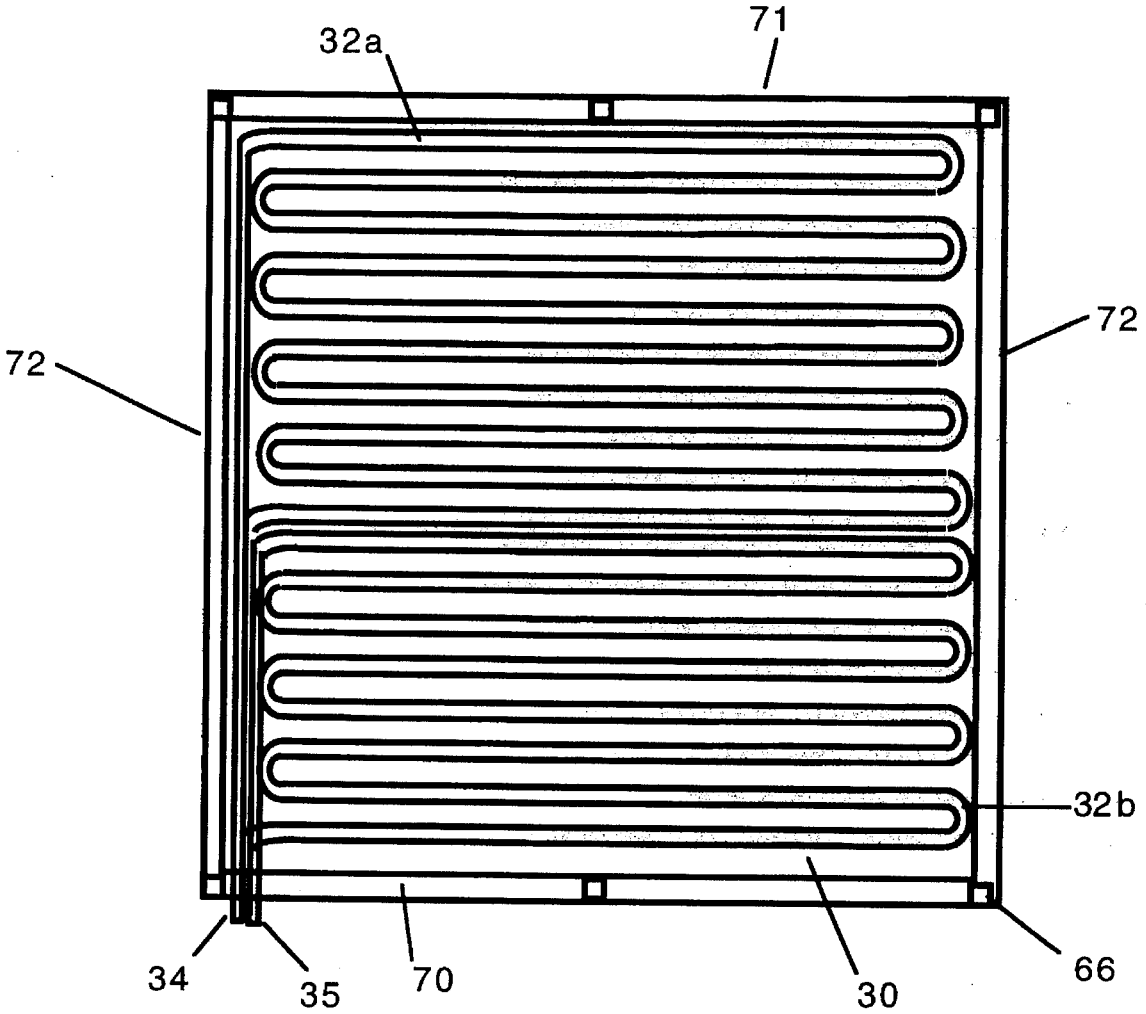
FIG. 6 is a top view of the upper set of melting pipes taken along the lines 6—6.
Figure 7:
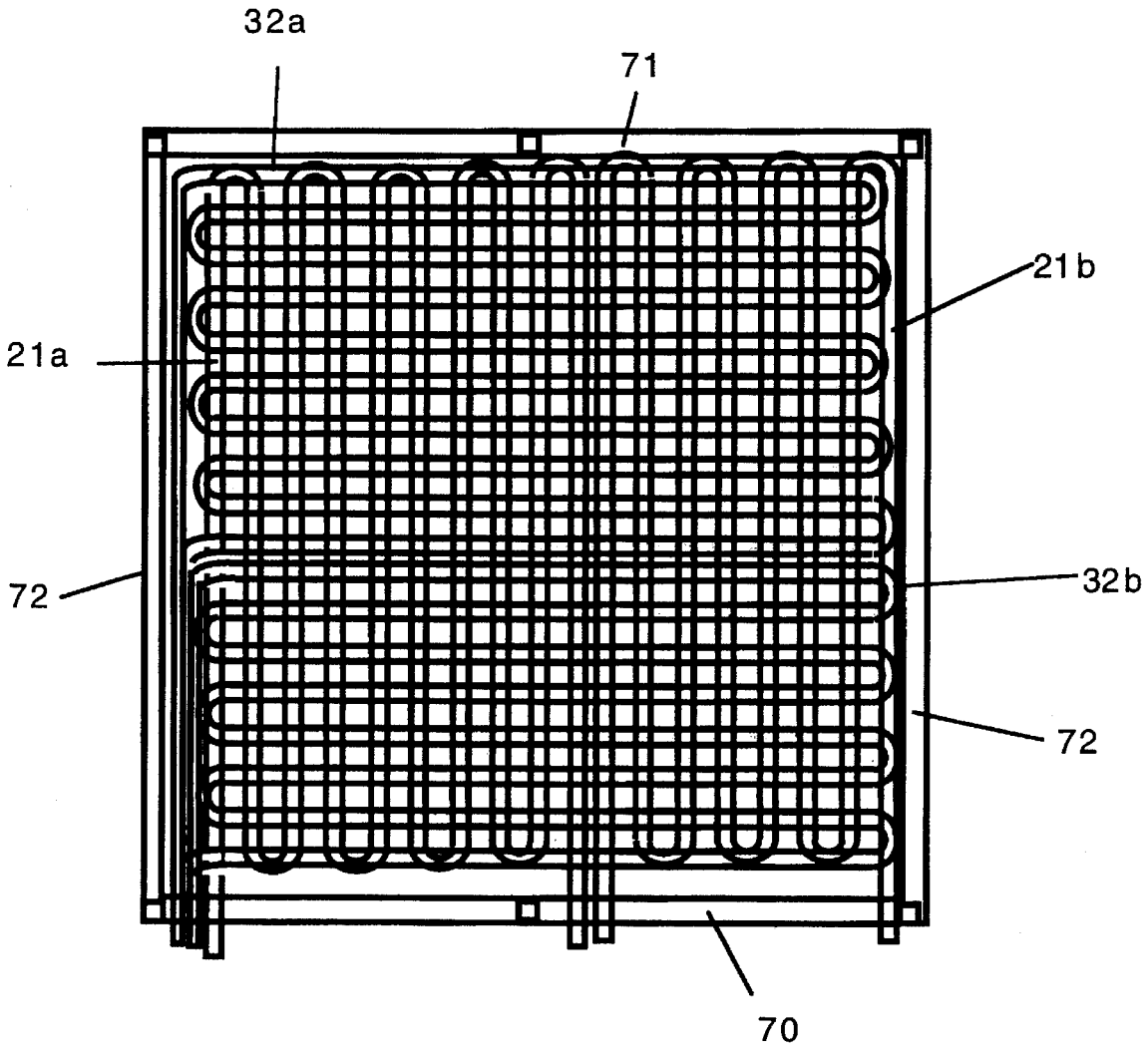
FIG. 7 is a top view showing both sets of melting pipes.
Figure 8:
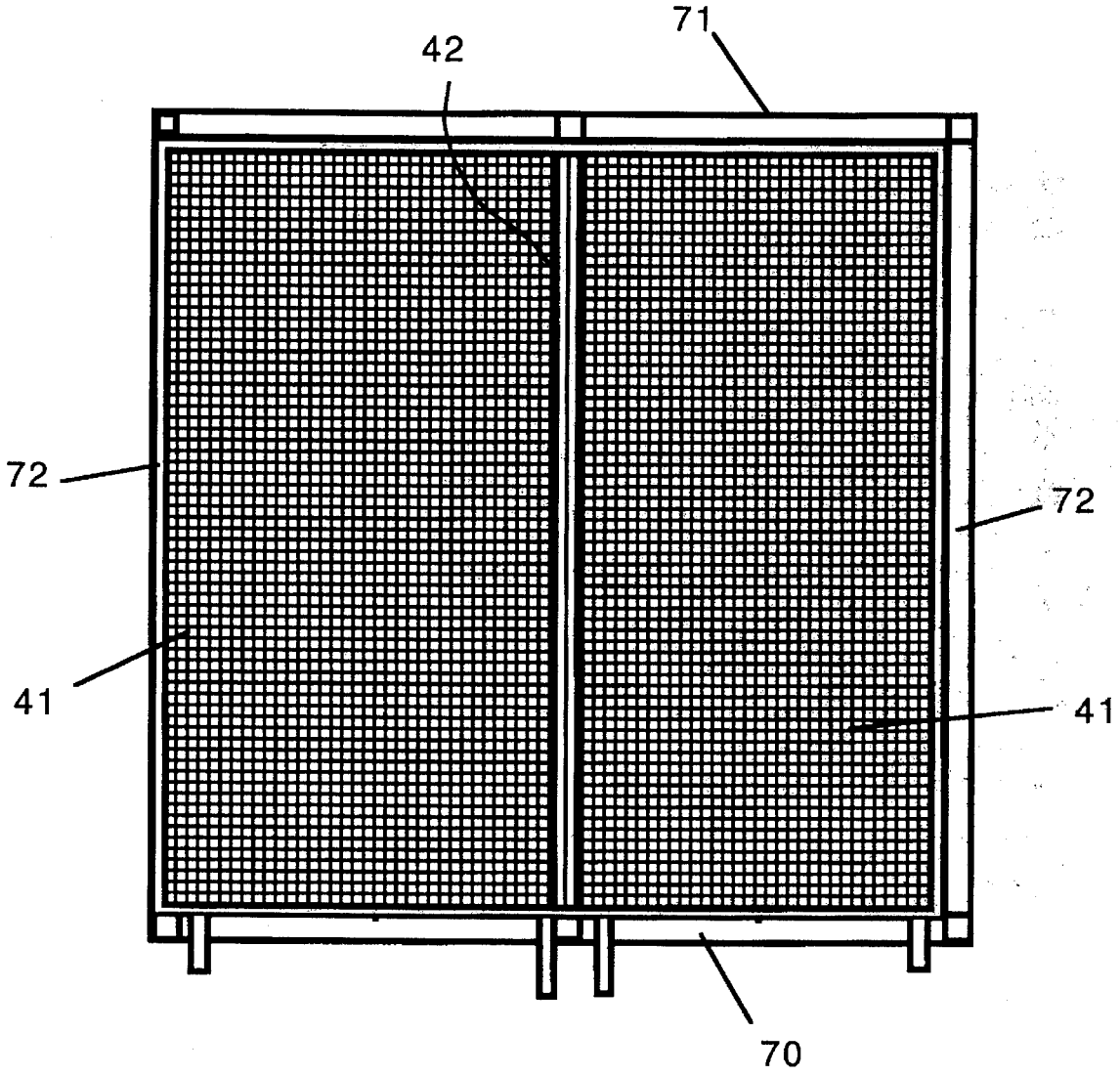
FIG. 8 is a top view of the screen taken along the lines 8—8.

Above the pyramids 15*a* and 15*b*, a shelf 19 is attached to the side walls 72 of the hopper 6. The shelf 19 is designed to support a tray 20 that holds a first row of pipes 21*a* and 21*b*. The first row of pipes 21*a* and 21*b* is arranged as shown in FIG. 5. Again, the pipes 21*a* and 21*b* are laid out on the tray 20 as shown. As in the case of the pyramids, water circulates through these pipes beginning at the inlet 22 for each set of pipes 21*a* and 21*b* and leaving at the outlet 23 for each set of pipes 21*a* and 21*b*.

Above the first set of pipes 21*a* and 21*b*, is a second shelf 30 and tray 31 to support a second row of pipes 32. See FIG. 6. The second row of pipes 32 is arranged at right angles to the first row of pipes 21*a* and 21*b*. See, FIG. 7. As before, the second set of pipes 32 of pipes is laid out in two sets of pipes, 32*a* and 32*b*, laid out on the tray 31 as shown. As in the case of the other systems, hot water circulates through the second set of pipes 32 beginning at the inlet 34 for each set and leaving at the outlet 35 for each set.

Above the second set of pipes 32 is another shelf 40 to support a screen 41. The screen 41 is used to catch debris and prevent it from entering the lower portions of the melting hopper 6. The screen is split into two sections for easy removal for maintenance. A bracket 42 joins the two screens 41 together as shown. See FIG. 8

As shown in FIG. 3, a curved, top pipe 50 is positioned against the back wall 71 of the hopper 6 as shown. The top pipe 50 circulates hot water through an inlet 51 and an outlet 52. The top pipe 50 is supported by two brackets 53 as shown. As discussed below, the top pipe 50 is used to keep the back wall 71 of the hopper 6 free of snow. As snow is blown into the hopper 6, it gathers and builds up on the rear wall 71. To prevent this snow from freezing and clogging the hopper 6, hot water is circulated through the top pipe 50 to melt this snow and keep the hopper 6 clear.

All the pipes and pyramids discussed above are connected to a set of boilers 60, discussed below.

Figure 9:
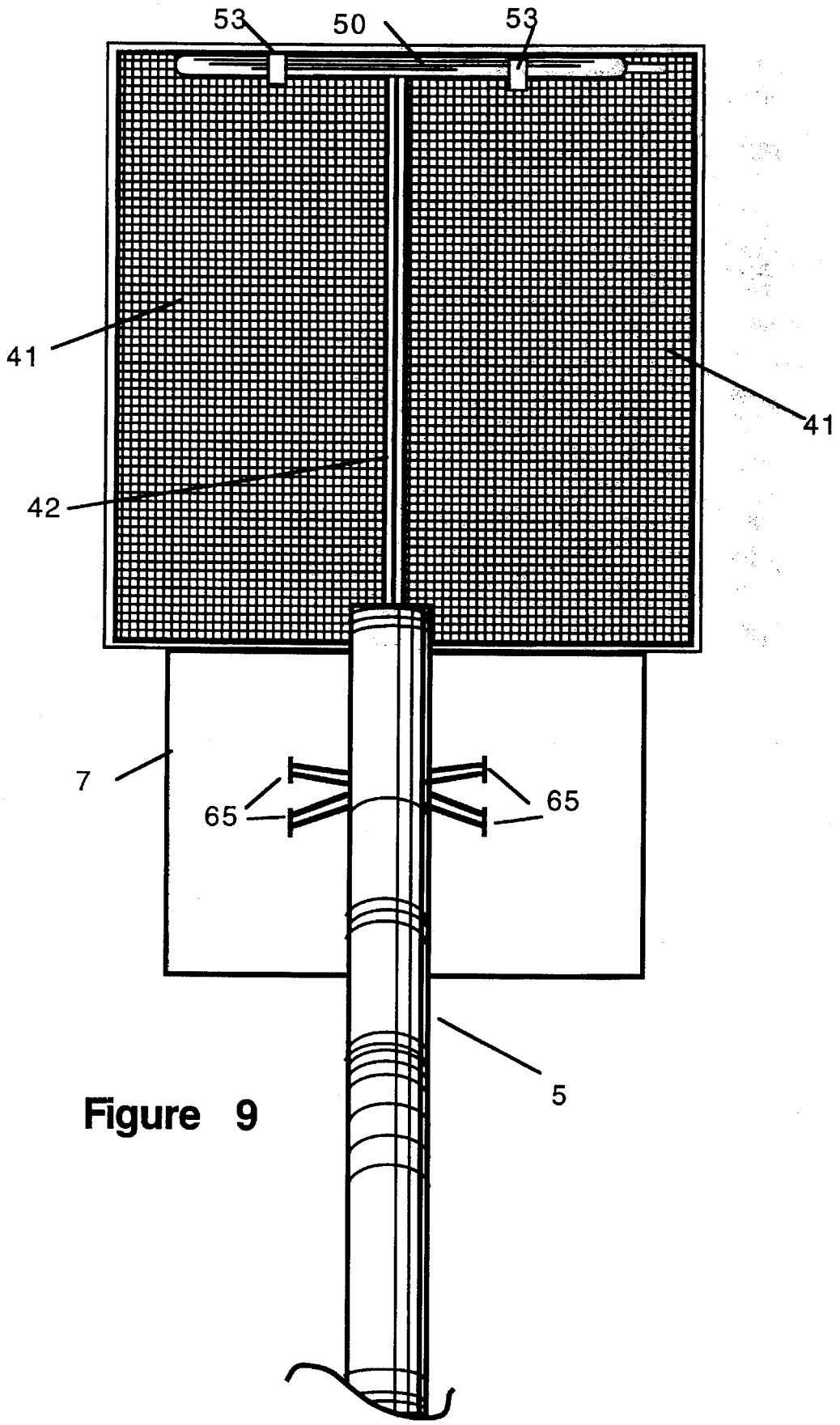
FIG. 9 is a top detail view of the hopper and the snow blower feeder pipe as it feeds into the hopper.

FIGS. 1, 2 and 9 show details of the snow delivery system. A standard road type rotary snow blower 4 is mounted on the front of the tractor 2 as shown. Unlike ordinary snow blowers, which discharge snow from the blower into a chute where it is directed away from the truck and merely blown into the air, this snow blower 4 has a duct (feeder chute) 5 attached to the output chute. This duct feeds into the hopper 6 at a point above the screen 41 as shown. The duct 5 is supported with legs 65 that extend above the cab and the boiler room 7 as shown. As snow is blown into the melting hopper 6, it strikes the screen 41 where rising heat causes the snow to melt. The melting snow passes through the screen 41 and over the pipes 32 and 21*a* and 21*b*, and then over the pyramids, ensuring thorough melting. Water collected at the bottom of the hopper 6 passes through a series of drains 66 and is collected under the hopper 6. The space under the hopper 6 acts as a funnel 130 to collect and move the melt water to a pump 120, discussed below. The melt water is then pumped into the holding tank 8 at the back of the trailer 3.

Figure 10:
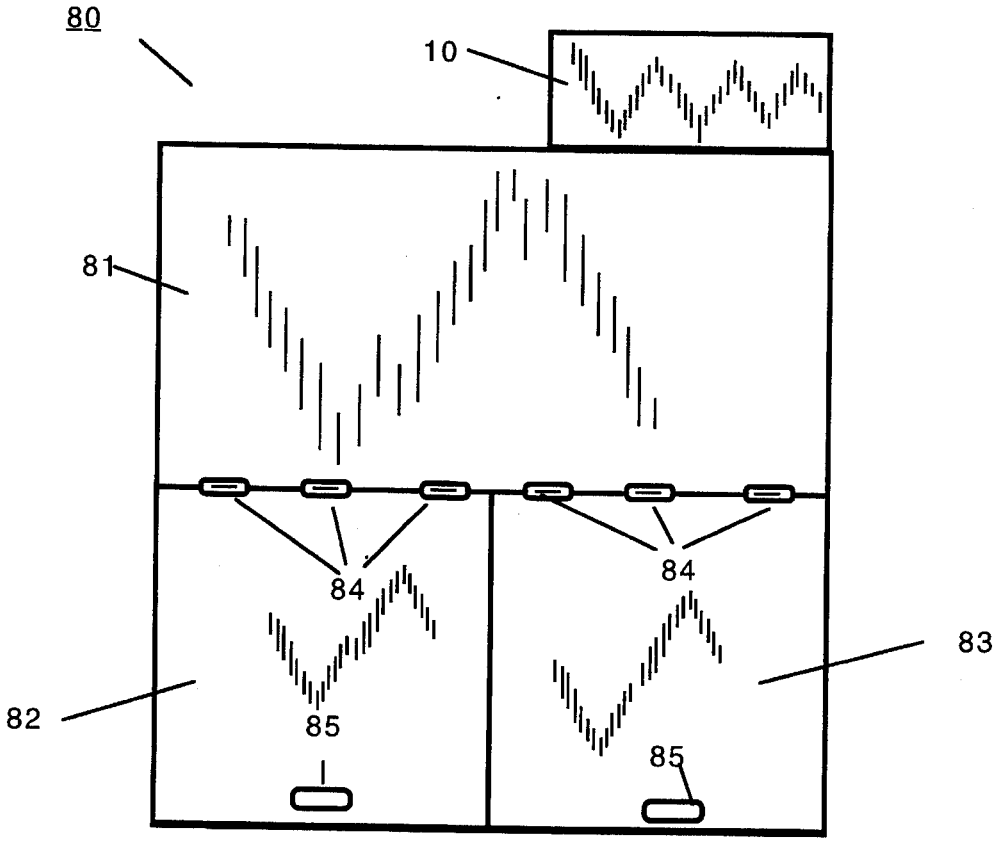
FIG. 10 is a top view of the hopper cover.

FIG. 10 shows the cover 80 for the melting hopper 6. The cover 80 fits over the entire top of the hopper 6 and may extend slightly over the edges of the hopper 6. The cover 80 is split into three sections. First, the rear section 81 covers one-half of the hopper 6 and is secured to the top of the hopper 6. The other half of the cover 80 is split into two sections 82 and 83, which are connected to the rear cover portion 81 with hinges 84. Handles 85 are provided so that the covers 81, 82 or 83 can be lifted for maintenance and to clean the screen 41 as needed.

Figure 11:
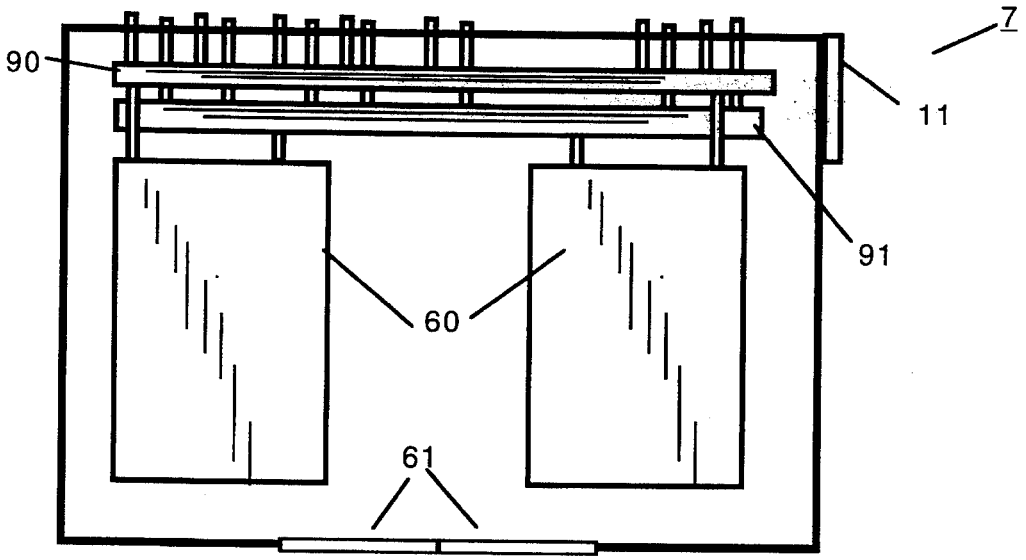
FIG. 11 is a top interior view of the boiler room.

FIG. 11 shows the boiler room 7. In the preferred embodiment, two boilers 60 are used to generate hot water for the melting process. In the preferred embodiment, the boilers 60 are rated at 538,000 Btu per hour total output of both boilers 60. The boilers 60 are connected to the pipe systems through plumbing manifolds 90 and 91 (the former for the various outlet lines and the latter for the various inlet lines) that are valved as necessary, using techniques that are standard in the art. Two doors 61 are used for access to the boiler room and are arranged as shown. Fuel for the system is held in a tank 10 mounted on the back of the hopper 6 as shown. Of course, a single boiler may be used as well, but this is not the preferred design.

A generator (not shown) and other appurtenant equipment are also provided to operate the boilers and to provide lighting as needed. Such a generator is installed using standard techniques.

A ladder 11 is attached to the side of the boiler room 7 (see also FIG. 2) for access to the hopper 6.

To use the system, as discussed above, snow is blown from the road surface into the melting hopper 6, where heat causes the snow to melt. Melt water is collected in the bottom of the hopper 6 where it is pumped, using a pump 120, into the water tank 8 for storage and ultimate disposal. Although a water tank 8 is the preferred storage device, any suitable container may be used.

The system can be operated by a one or two person crew and no additional support people or equipment are needed.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A snow removal system comprising:

a) a means for collecting snow from a ground surface;

b) a hopper, having a front wall, a rear wall, two oppositely disposed sides and a floor;

c) at least one boiler in thermal communication with said means for melting snow;

d) a means for transferring said snow from the means for collecting snow, to said hopper;

e) a means for melting snow, fixedly placed within said hopper, said means for melting snow including: i) a plurality of elongated pyramids being hydraulically interconnected and also being connected to said boiler to allow a flow of heated water therethrough;

f) a means for collecting melted snow, fixedly placed within said hopper;

g) a container for receiving and storing the melted snow;

h) a heating pipe, fixedly mounted to the rear wall of said hopper, above said screen to melt snow accumulating on said rear wall of said hopper; and i) a means for pumping said melted snow from said hopper to said container for receiving and storing said melted snow.

2. The snow removal system of claim 1 where said snow removal system is mounted on a tractor-trailer type vehicle.

3. The snow removal system of claim 1 wherein the means for melting snow further comprises:

a) a first set of heating pipes, in thermal communication with said boiler and being placed above said plurality of pyramids;

b) means for supporting said first set of heating pipes;

c) a second set of heating pipes, placed above said first set of heating pipes and being in thermal communication with said boiler; and d) means for supporting said second set of heating pipes.

4. The snow removal system of claim 3 further comprising a screen placed above said second set of pipes, to catch debris entering the hopper; and means for supporting said screen.

5. The snow removal system of claim 1 wherein said means for collecting melted snow in said hopper; comprises a plurality of drains formed within the floor of said hopper; and a funnel formed under said hopper to gather melted snow into a concentrated location for pumping said snow to the container for receiving melted snow.

6. The snow removal system of claim 5 wherein the means for collecting snow from a ground surface comprises a snow blower.

7. A snow removal system, installed on a truck chassis having a cab and a rear platform comprising:

a) a snow blower mounted on said cab of said truck chassis;

b) a hopper, having a front wall, a rear wall, two oppositely disposed sides and a floor, fixedly mounted on said rear platform of said truck chassis, said hopper also having a plurality of drains formed within the floor of said hopper and a funnel formed under said hopper to gather melted snow into a concentrated location;

c) a pipe, having an inlet, connected to said snow blower whereby snow that is collected by said snow blower is fed into said pipe, and an outlet that is removably positioned within said hopper such that snow in said pipe is discharged into said hopper;

d) at least one boiler in thermal communication with a means for melting snow, fixedly placed within said hopper, said means for melting snow including: i) a plurality of elongated pyramids being hydraulically interconnected and also being connected to said boiler to allow a flow of heated water therethrough, e) a tank, for receiving melted snow, fixedly attached to the rear platform of said truck chassis;

f) a heating pipe, fixedly mounted to the rear wall of said hopper, above said screen to melt snow accumulating on said rear wall of said hopper; and g) a pump, fixedly attached to said truck chassis, for pumping said melted snow from said hopper to said tank.

8. The snow removal system of claim 7 wherein the means for melting snow further comprises:

a) a first set of heating pipes, in thermal communication with said boiler and being placed above said plurality of pyramids;

b) means for supporting said first set of heating pipes;

c) a second set of heating pipes, placed above said first set of heating pipes and being in thermal communication with said boiler; and d) means for supporting said second set of heating pipes.

9. The snow removal system of claim 8 further comprising a screen placed above said second set of pipes, to catch debris entering the hopper; and means for supporting said screen.

10. The method of removing snow from ground surfaces comprising the steps of:

a) collecting snow from a ground surface;

b) transferring said snow from the means for collecting snow from a ground surface, to a hopper, having a front wall, a rear wall, two oppositely disposed sides, and a floor;

c) melting the snow placed in the hopper by passing heated water from a boiler through a set of elongated pyramids being hydraulically connected to said boiler and by passing heated water through a pipe mounted on the rear wall of said hopper;

d) collecting the melted snow from said hopper; and e) pumping said melted snow from said hopper to a container for receiving melted snow.

11. The method of removing snow from ground surfaces of claim 10 wherein the step of melting snow further comprises the steps of:

a) passing heated water from said boiler through a first set of heating pipes, in thermal communication with said boiler and being placed above said plurality of pyramids; and b) passing heated water from said boiler through a second set of heating pipes, placed above said first set of heating pipes and being in thermal communication with said boiler.

* * * * *